US006725685B2

(12) United States Patent
Kang

(10) Patent No.: US 6,725,685 B2
(45) Date of Patent: Apr. 27, 2004

(54) ICE MAKER OF REFRIGERATOR

(75) Inventor: Deok-Eun Kang, Gyungsangnam-Do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/423,865

(22) Filed: Apr. 28, 2003

(65) Prior Publication Data

US 2003/0213262 A1 Nov. 20, 2003

(30) Foreign Application Priority Data

May 14, 2002 (KR) ..... 2002-26478

(51) Int. Cl.[7] ..... F25C 1/12
(52) U.S. Cl. ..... 62/347; 62/353
(58) Field of Search ..... 62/74, 347, 353

(56) References Cited

U.S. PATENT DOCUMENTS 6,161,390 A * 12/2000 Kim ..... 62/72
6,470,701 B2 * 10/2002 Tchougounov et al. ..... 62/347

FOREIGN PATENT DOCUMENTS

JP 5-172445 * 5/1993
JP 6-201237 * 6/1994

* cited by examiner

*Primary Examiner*—William E. Tapoloai
(74) *Attorney, Agent, or Firm*—Fleshner & Kim, LLP

(57) ABSTRACT

An ice maker for a refrigerator comprises an ice making vessel installed on a front portion of a main body of the refrigerator to perform an ice making operation; a water supplying pipe for ice making installed on an upper part of the ice making vessel as apart a predetermined distance from the ice making vessel to supply water into the ice making vessel; a buffer member installed on the water supplying pipe for ice making to buff a shock by contacting to the ice making vessel when the ice making vessel is rotated for an ice separating process; and a guide member mounted on one side of the buffer member for guiding the water discharged from the water supplying pipe for ice making into the ice making vessel, in order to prevent respective components from being damaged by interference between the ice making vessel and the pipes supplying the water into the vessel and to prevent the water in the ice making vessel from being induced into a storing vessel so that ices in the storing vessel are not stuck to each other.

10 Claims, 4 Drawing Sheets

ICE MAKER OF REFRIGERATOR

BACKGROUND OF THE INVENTION

1. Field of the Invention

The present invention relates to an ice maker of a refrigerator, and particularly, to an ice maker of a refrigerator which is able to prevent a damage and a wrong operation due to contact of a water supplying apparatus and the ice maker during a separating process of the ice maker.

2. Description of the Background Art

Generally, an ice maker is a device installed additionally on a freezing apparatus and on a cooling apparatus for making ices using a cooling cycle disposed on the freezing and cooling apparatuses.

FIG. 1 is a perspective view showing a refrigerator including a general ice maker.

The conventional refrigerator comprises an ice making vessel 2 for freezing water in order to provide a user with ices, a containing vessel 4 installed on a lower part of the ice making vessel 2 for storing the ices made in the ice making vessel 2, and a dispenser 6 for providing the user with water. In addition, the ice making vessel 2 and the dispenser 6 are connected to a water supplying apparatus respectively to be supplied the water.

The water supplying device comprises: a first water supplying pipe 10 connected to a rear portion of a refrigerator main body 8 to supply the water from a water supplying source on outer part into the refrigerator, a switching valve 12 connected to the first water supplying pipe 10 to perform switching operation, a second water supplying pipe 14 connected to the switching valve 12 to supply the water to the ice making vessel 2, and a third water supplying pipe 15 connected to the switching valve 12 to supply the water to the dispenser 6.

Herein, the switching valve 12 connects the first water supplying pipe 10 to one of the second water supplying pipe 14 and the third water supplying pipe 15 to supply the water selectively to the ice making vessel 2 and to the dispenser 6.

In addition, a water tank 18 which is able to store a predetermined amount of water is connected to the third water supplying pipe 15.

FIG. 2 is a partial cross-sectional view showing the water supplying device which supplies the water to the ice making vessel according to the conventional art.

The second water supplying pipe 14 is connected to the switching valve 12 and extended upward on the rear portion of the main body 8 of the refrigerator, and connected to a water supplying pipe for ice making 16 inserted into the refrigerator.

The water supplying pipe for ice making 16 is disposed to be slanted as a certain angle so as to supply the water easily into the ice making vessel 2, and an inlet 20 of the pipe 16 is located on an upper part of the ice making vessel 2 with a certain gap from the ice making vessel 2.

Operations of the ice maker for the refrigerator constructed as above according to the conventional art will be described as follows.

When the water is supplied from the outer water supplying source through the first water supplying pipe 10 and the switching valve 12 is operated, the water is induced into the second water supplying pipe 14 and the water is supplied into the ice making vessel 2 through the water supplying pipe 16 for ice making connected to the second water supplying pipe 14.

Then, the water filled in the ice making vessel 2 is frozen by the operation of the cooling cycle, and when the ice making is completed, the ice making vessel 2 is rotated to transfer the ices to the storing vessel 4.

However, according to the ice maker for the refrigerator of the conventional art, when some difference is generated during installing the water supplying pipe for ice making 16 to narrow the gap between the inlet 20 of the water supplying pipe for ice making 16 and the ice making vessel 2, the ice making vessel 2 is crashed into the water supplying pipe for ice making 16 when the ice making vessel 2 is rotated in the ice separating process. And accordingly, the ice making vessel 2 or the water supplying pipe for ice making 16 may be damaged, or the water supplying pipe for ice making 16 is escaped from the original position, and thereby, the water is not supplied precisely into the ice making vessel 2.

Also, since the water is supplied from the water supplying pipe for ice making 16 to the ice making vessel 2 in free fall, the water may be splashed out of the ice making vessel 2 in case that pressure, amount or speed of the supplying water is not maintained evenly. And the water splashed out of the ice making vessel 2 may be induced into the storing vessel 4 installed on the lower part of the ice making vessel 2, and then, the ices stored in the storing vessel 4 are stuck to each other.

SUMMARY OF THE INVENTION

Therefore, an object of the present invention is to provide an ice maker of a refrigerator which is able to prevent respective components from being damaged by interference between an ice making vessel and a pipe which supplied water to the ice making vessel during an ice separating process and to improve reliability in ice making function.

Another object of the present invention is to provide an ice maker of a refrigerator which is able to prevent ices in a storing vessel from being stuck to each other by preventing the water supplied into an ice making vessel from being induced into the storing vessel.

To achieve the objects of the present invention, as embodied and broadly described herein, there is provided an ice maker of a refrigerator comprising: an ice making vessel installed on a front portion of a refrigerator main body for making ices; a water supplying pipe for ice making installed on an upper part of the ice making vessel with a predetermined distance therebetween to supply the water into the ice making vessel; and a buffer member installed on the water supplying pipe for ice making in order to soften shock generated when the ice making vessel is rotated for ice separating process.

The buffer member comprises: a coupled portion which is coupled with an inlet of the water supplying pipe for ice making; and a buffer portion extended from the coupled portion as a predetermined length to guide the water into the ice making vessel and to buff the shock when the ice making vessel is contacted due to the rotation.

The buffer member is a pipe of cylindrical shape of rubber material.

Also, there is provided an ice maker of a refrigerator comprising: an ice making vessel installed on a front portion of a main body of the refrigerator to be rotatable to make ices; a water supplying pipe for ice making installed on an upper part of the ice making vessel with a predetermined distance therebetween for supplying water into the ice making vessel; a buffer member installed on the water supplying pipe for ice making to soften the shock by a contact with the ice making vessel when the ice making vessel is rotated for an ice separating process; and a guide member mounted on one side of the buffer member for guiding the water so that the water discharged from an outlet of the water supplying pipe only can be induced into the ice making vessel.

The guide member is mounted on upper part of the inlet of the buffer member as having a certain elastic force, and formed as a plate for covering the inlet of the buffer member as a certain width.

The guide member is formed as a plate of rubber material having a certain elastic force.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

There may be a plurality of embodiments of an ice maker for a refrigerator according to the present invention, and the most preferred embodiment will be described as follows.

Figure 4:
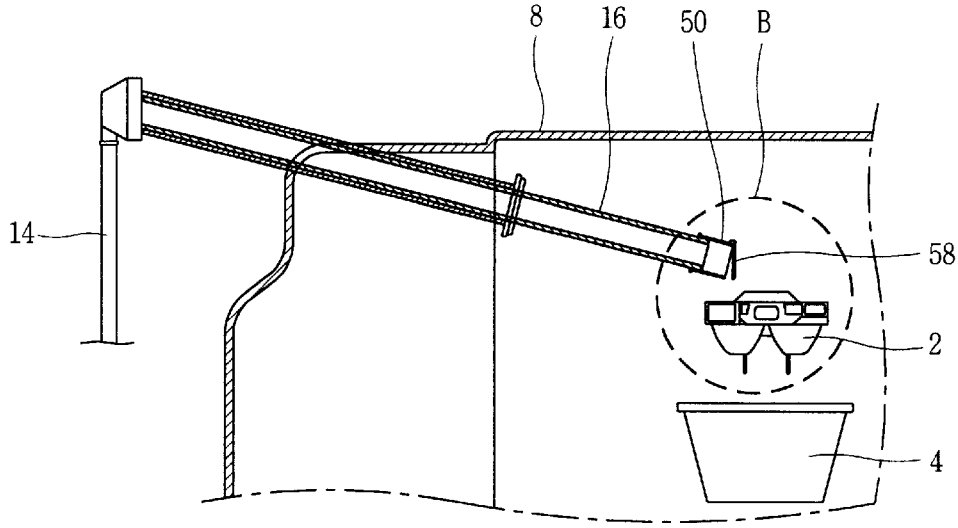
FIG. 4 is a cross-sectional view showing a water supplying device in an ice maker of a refrigerator according to the present invention.

FIG. 4 is a cross-sectional view showing a part of a water supplying device in the ice maker of the refrigerator according to the present invention.

Figure 1:
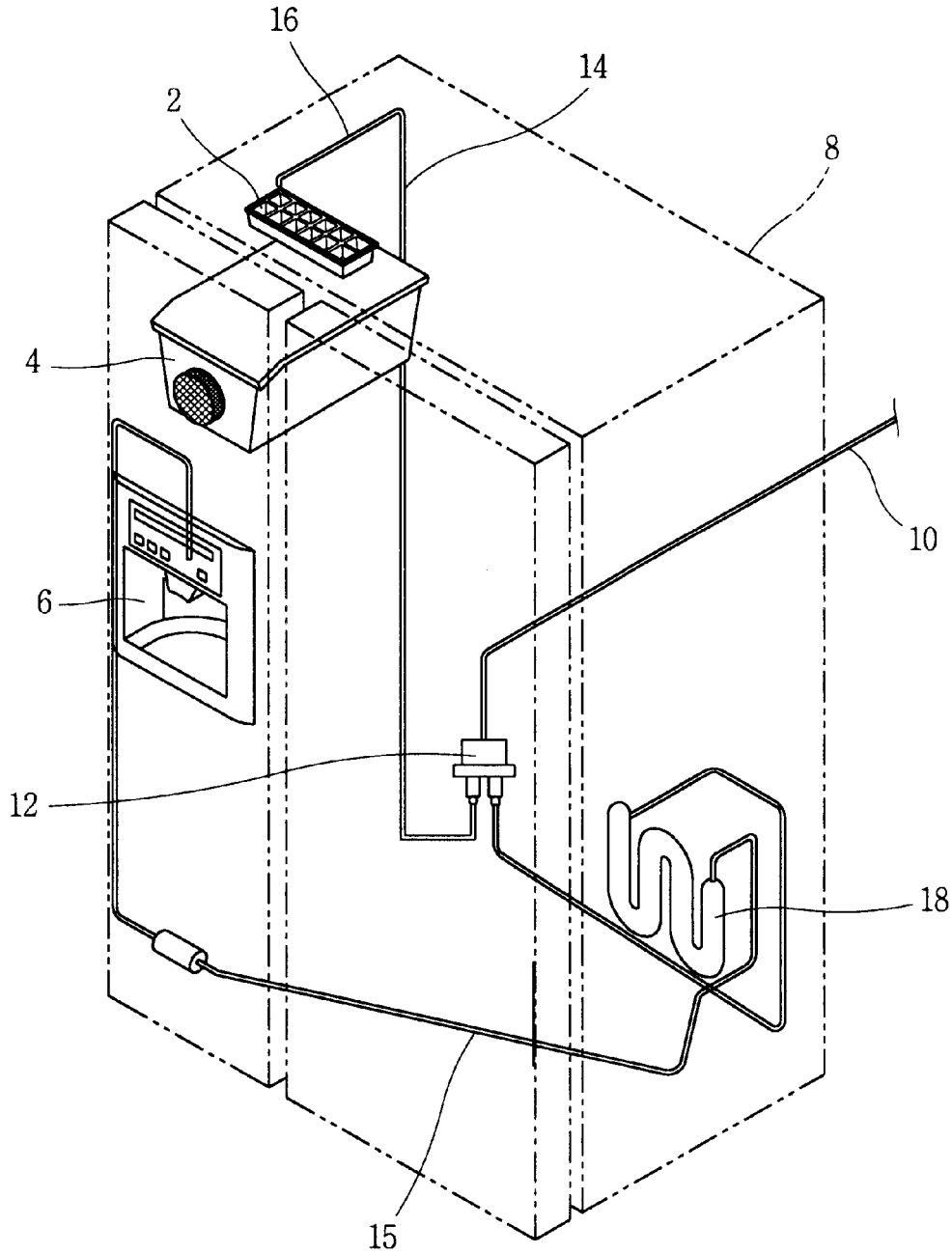
FIG. 1 CONVENTIONAL ART
FIG. 1 is a perspective view showing a refrigerator including a general ice maker.
Figure 2:
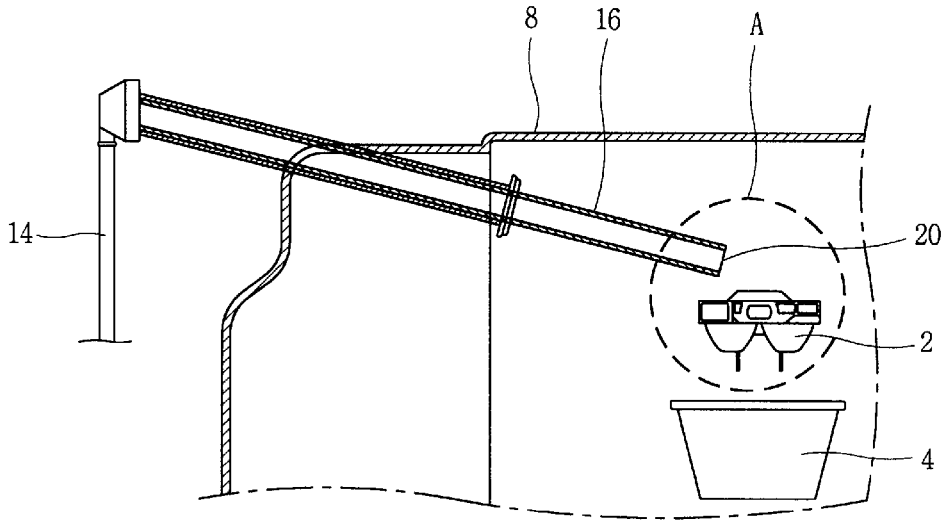
FIG. 2 CONVENTIONAL ART
FIG. 2 is a cross-sectional view showing a part of a water supplying device in the ice maker of refrigerator according to the conventional art.
Figure 3:
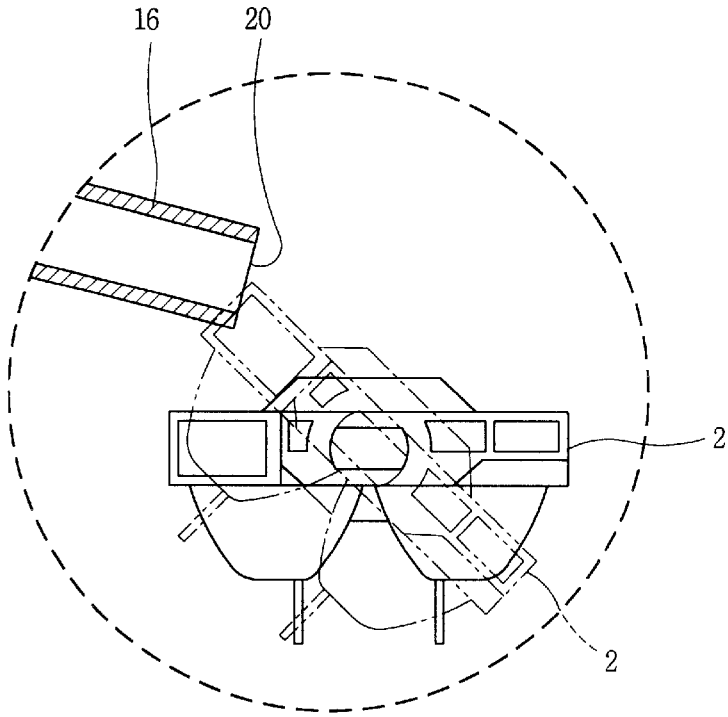
FIG. 3 CONVENTIONAL ART
FIG. 3 is an expanded view showing part A in FIG. 2.

Referring to FIG. 1, a refrigerator according to the present invention comprises: an ice making vessel 2 for making ices; a storing vessel 4 for storing ices on lower part of the ice making vessel 2; a dispenser 6 for providing a user with water on front portion of a main body 8 of the refrigerator; and a water supplying device installed on rear portion of the refrigerator for supplying water to the ice making vessel 2 and the dispenser 6.

The ice making vessel 2 is installed on the front portion of the main body 8 to be rotatable, and has a plurality of cavities in which the water is filled. And the ice making vessel 2 performs the ice making operation using cool air provided by a cooling cycle.

The water supplying device comprises: a first water supplying pipe 10 installed on the rear portion of the main body 8 supplying water into the refrigerator from an outer water supplying source; a switching valve 12 connected to the first water supplying pipe 10 for switching operation; a second water supplying pipe 14 connected to the switching valve 12 to supply the water into the ice making vessel 2; and a third water supplying pipe 15 connected to the switching valve 12 for supplying the water into the dispenser 6.

Herein, the switching valve 12 switches the first water supplying pipe 10 so as to be communicated with one of the second and third water supplying pipes 14 and 15, and thereby, the water supplied into the first water supplying pipe 10 can be supplied to one of the ice making vessel 2 and the dispenser 6.

The second water supplying pipe 14 is connected to the switching valve 12 and extended upward on rear outer portion of the main body 8, and connected to a water supplying pipe for ice making 16 which is inserted into the main body 8 of the refrigerator.

Herein, the water supplying pipe for ice making 16 has one end connected to the second water supplying pipe 14 and inserted into the refrigerator on the rear portion of the refrigerator and the other end, that is, an inlet 20 located on upper part of the ice making vessel 2 so as to supply the water into the ice making vessel 2 by free fall.

The water supplying pipe for ice making 16 is installed to be slanted at a certain angle in order to supply the water into the ice making vessel 2 easily, and a buffer member 50 is installed on the inlet 20 of the pipe 16 for buffing the shock generated by contacting to the ice making vessel 2 when the ice making vessel 2 is rotated.

Figure 5:
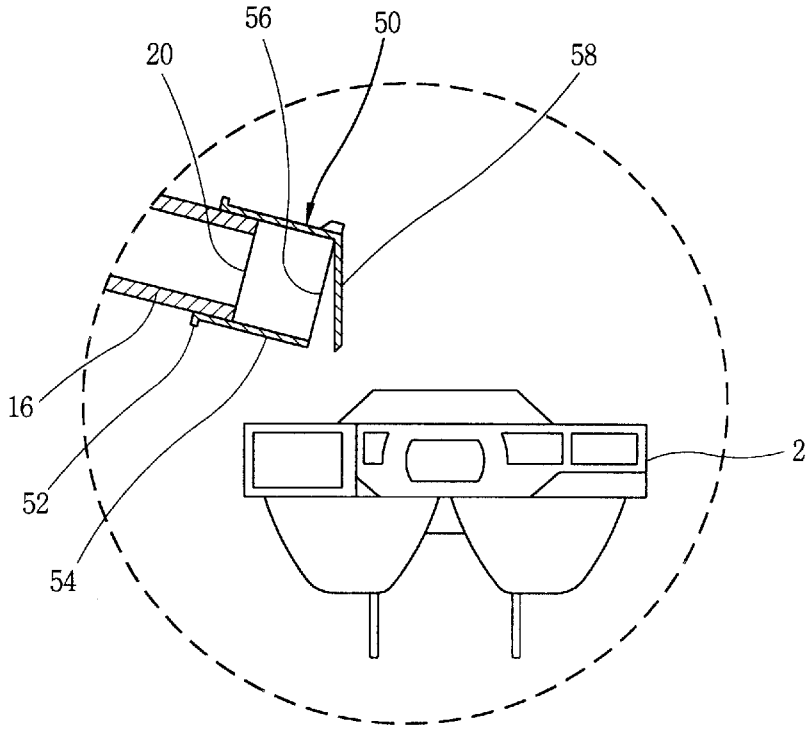
FIG. 5 is an expanded view showing part B in FIG. 4.

As shown in FIG. 5, the buffer member 50 comprises: a coupled portion 52 of which one side is coupled to the inlet 20 of the water supplying pipe for ice making 16, and a buffer portion 54 extended from the coupled portion 52 to be a predetermined length for guiding the water into the ice making vessel 2 and for buffing the shock generated by the contact with the ice making vessel 2 when the ice making vessel 2 is rotated.

The coupled portion 52 is formed using a cylindrical flexible material which is coupled by being inserted into the inlet 20 of the water supplying pipe for ice making 16 and the buffer portion 43 is extended from the coupled portion to be a predetermined length. That is, it is desirable that the buffer member 50 is made of a rubber pipe of cylindrical shape.

In addition, a guide member 58 is installed on an inlet 56 of the buffer member 50 in order to guide the water discharged from the water supplying pipe for ice making 16 so as to be supplied into the ice making vessel 2 precisely.

That is, in case that pressure, amount or speed of the water supplied from the water supplying pipe for ice making 16 is not maintained evenly, the water supplied into the ice making vessel 2 is splashed out of the ice making vessel 2. Then, the guide member 58 prevents the water supplied into the ice making vessel 2 from being splashed out of the ice making vessel 2 regardless of the water supplying conditions as above (water pressure, amount or speed).

The guide member 58 is fixed on upper side of the inlet 56 of the buffer member 50, and formed as a plate covering the inlet 56 of the buffer member 50 as a predetermined angle. Therefore, the water discharged from the inlet 56 of the buffer member 50 is moved downward along with the guide member 58 and supplied into the ice making vessel 2.

The above guide member 58 is integrally formed on upper part of the buffer member 50 with a predetermined elastic force toward a direction becoming distant from the buffer member 50, or may be installed on the upper part of the buffer member 50 after being formed separately.

Operations of the ice maker constructed as above according to the present invention will be described as follows.

Figure 6:
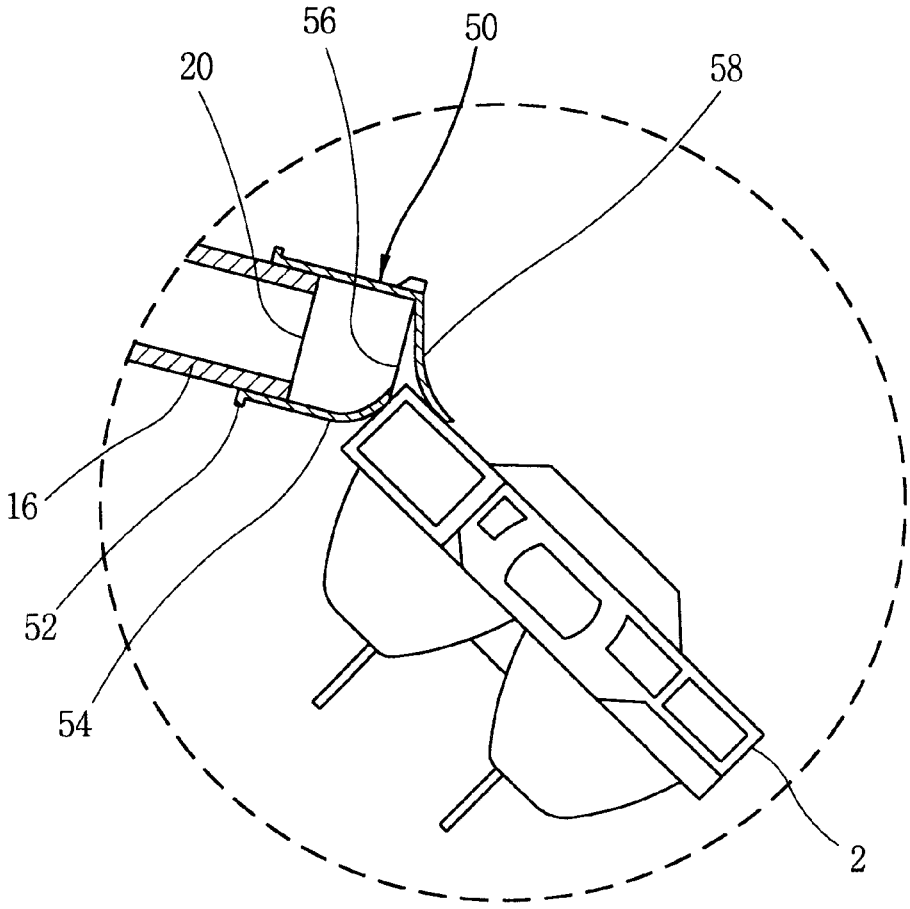
FIG. 6 is a view showing an operational status of the ice maker for refrigerator according to the present invention.

FIG. 6 is a view showing an operational status of the ice maker according to the present invention.

When the water is supplied into the refrigerator from an outer water supplying source through the first water supplying pipe 10 and induced into the second water supplying pipe 14 according to the operation of the switching valve 12, the water is supplied into the ice making vessel 2 through the water supplying pipe for ice making 16 which is connected with the second water supplying pipe 14.

At that time, the water discharged through the water supplying pipe for ice making 16 is guided by the guide member 58, and then, safely supplied into the ice making vessel 2 regardless of the water supplying conditions, that is, the water pressure, water amount and the speed so that the water is not splashed out of the ice making vessel 2 or is not leaked.

In addition, when the water is filled in the ice making vessel 2, the ice making process is performed according to the operation of the cooling cycle, and when the ice making process is completed, the ice making vessel 2 is rotated to store the ices in the storing vessel 4 installed on the lower part of the ice making vessel 2.

At that time, since the ice making vessel 2 is contacted to the buffer member 50 even in case that the water supplying pipe for ice making 16 is installed nearly to the ice making vessel during the rotation of the ice making vessel 2, one side of the buffer member 50 where the ice making vessel 2 is contacted is distorted not to disturb the rotation of the ice making vessel 2. In addition, when the rotation of the ice making vessel 2 is completed, the buffer member 50 returns to the original status by the elastic force of itself. Therefore, the rotation of the ice making vessel 2 is not interfered when the ice making vessel 2 is rotated, even in case that the water supplying pipe for ice making 16 is installed nearly to the ice making vessel 2, and therefore, damage of the water supplying pipe for ice making 16 or of the ice making vessel 2 can be prevented.

As described above, according to the ice maker for refrigerator of the present invention, the water can be supplied into the ice making vessel safely regardless of the water supplying conditions (pressure, amount or speed of the water) when the water is supplied into the ice making vessel, by installing the guide member on the inlet of the water supplying pipe for ice making. Therefore, the water supplied into the ice making vessel is not escaped from the ice making vessel, and therefore, the ices in the storing vessel are not stuck to each other due to the water inducement.

Also, the buffer member is installed on the inlet of the water supplying pipe for ice making to prevent the ice making vessel from crashing into the water supplying pipe when the ice making vessel is rotated for the ice separating process, and therefore, the damage of the water supplying pipe for ice making and of the ice making vessel can be prevented and the reliability of the ice making operation can be improved.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An ice maker for a refrigerator comprising:

an ice making vessel installed on a front portion of a main body of the refrigerator to be rotatable for performing ice making operation;

a water supplying pipe for ice making installed on an upper part of the ice making vessel with a predetermined distance from the ice making vessel for supplying water into the ice making vessel; and a buffer member installed on the water supplying pipe for ice making to soften a shock generated by contacting to the ice making vessel when the ice making vessel is rotated for an ice separating process.

2. The ice maker of claim 1, wherein the buffer member comprises:

a coupled portion of which one side is coupled to an inlet of the water supplying pipe for ice making; and a buffer portion extended from the coupled portion to be a predetermined length to guide the water into the ice making vessel and to buff the shock when the ice making vessel is contacted to the pipe during rotation of the ice making vessel.

3. The ice maker of claim 2, wherein the coupled portion is inserted into the water supplying pipe for ice making, and the buffer portion is a pipe made of a flexible material which is able to minimize the shock and is extended integrally from the coupled portion.

4. The ice maker of claim 3, wherein the buffer member is a cylindrical pipe of a rubber material.

5. An ice maker for a refrigerator comprising:

an ice making vessel installed on a front portion of a main body of the refrigerator to perform an ice making operation;

a water supplying pipe for ice making installed on an upper part of the ice making vessel as apart a predetermined distance from the ice making vessel to supply water into the ice making vessel;

a buffer member installed on the water supplying pipe for ice making to buff a shock by contacting to the ice making vessel when the ice making vessel is rotated for an ice separating process; and a guide member mounted on one side of the buffer member for guiding the water discharged from the water supplying pipe for ice making into the ice making vessel.

6. The ice maker of claim 5, wherein the buffer member is a pipe of flexible material which is inserted into an inlet of the water supplying pipe for ice making to be extended as a predetermined length and which is able to minimize the shock when it is crashed with the ice making vessel.

7. The ice maker of claim 6, wherein the buffer member is a pipe of cylindrical shape made of a rubber material.

8. The ice maker of claim 5, wherein the guide member is installed on upper part of the buffer member as having a certain elastic force and formed as a plate for covering an inlet of the buffer member as much as a predetermined width.

9. The ice maker of claim 8, wherein the guide member is formed as a plate of a rubber material having a certain elastic force.

10. The ice maker of claim 5, wherein the buffer member and the guide member are formed integrally with each other.